United States Patent [19]

Larsen

[11] 4,030,306

[45] June 21, 1977

[54] APPARATUS FOR PREVENTING EROSION OF THE SEABED IN FRONT OF HYDRAULIC STRUCTURES

[76] Inventor: Ole Fjord Larsen, 62 Fasanvaenget, P.O. Box 604, DK 6700, Esbjerg, Denmark

[22] Filed: Aug. 14, 1975

[21] Appl. No.: 604,548

[52] U.S. Cl. ..... 61/3; 61/86
[51] Int. Cl.[2] ..... E02B 3/04
[58] Field of Search ..... 61/2, 1 R, 3, 4, 37, 61/38

[56] References Cited

UNITED STATES PATENTS

| | | | |
|---|---|---|---|
| 3,529,427 | 9/1970 | Titman | 61/1 R |
| 3,830,066 | 8/1974 | Larsen | 61/3 |
| 3,844,123 | 10/1974 | Larsen | 61/3 |

FOREIGN PATENTS OR APPLICATIONS

| | | | |
|---|---|---|---|
| 952,787 | 10/1956 | Germany | 61/3 |
| 351,233 | 2/1961 | Switzerland | 61/3 |
| 927,306 | 5/1963 | United Kingdom | 61/3 |

*Primary Examiner*—Paul R. Gilliam
*Assistant Examiner*—Alex Grosz
*Attorney, Agent, or Firm*—Diller, Brown, Ramik & Wight

[57] ABSTRACT

This disclosure relates to an apparatus for preventing erosion of the seabed in front of a lengthy hydraulic structure with a steep face comprising a sheet of rigid or flexible material which is unapertured or perforated, and means for supporting the sheet at an acute angle to the hydraulic structure with an upper edge thereof contiguous the steep face above the seabed and a lower opposite edge portion being remote from the steep face and being positioned adjacent the seabed.

5 Claims, 11 Drawing Figures

FIG.1
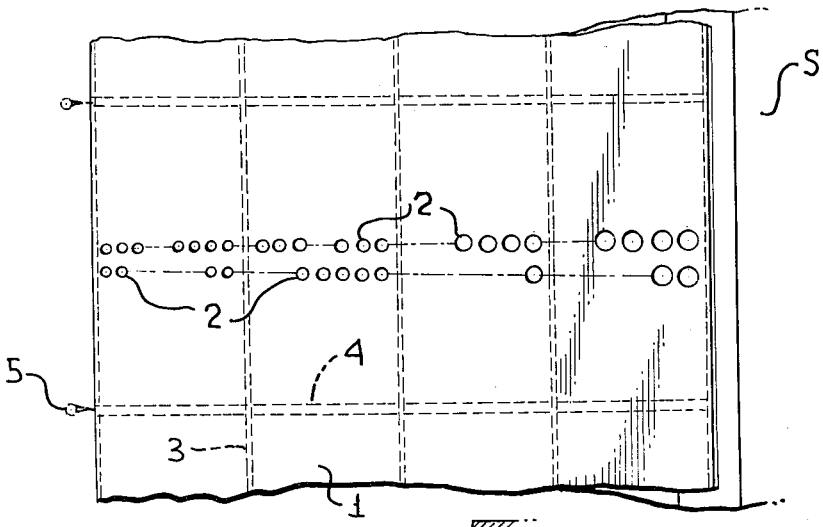
FIG.2
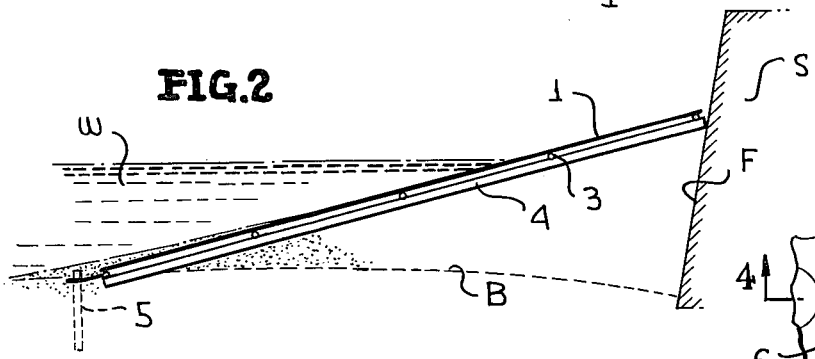
FIG.3
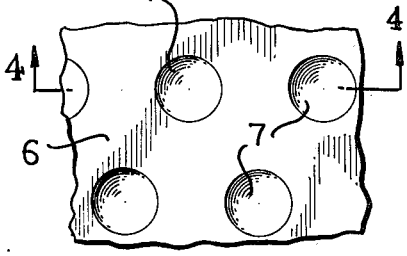
FIG.5
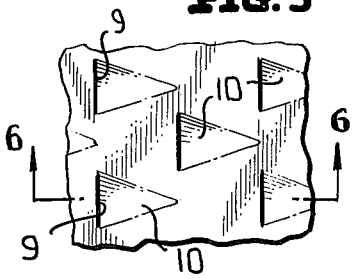
FIG.6
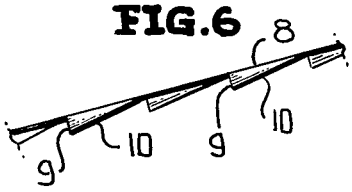
FIG.4
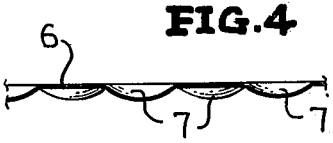
FIG.7
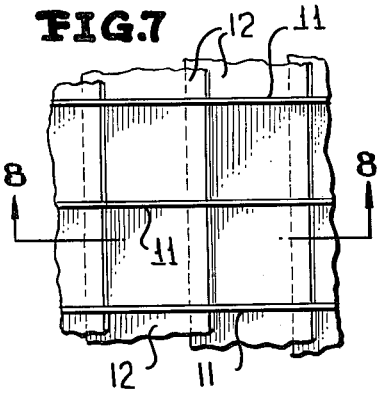
FIG.8
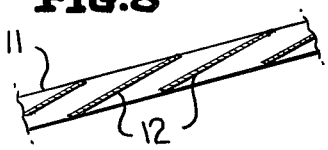
FIG.10
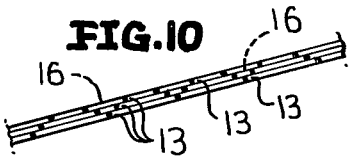
FIG.9
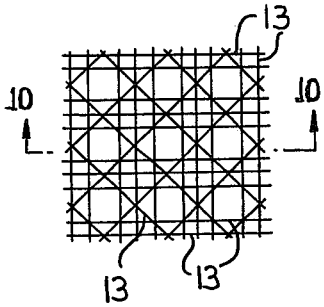
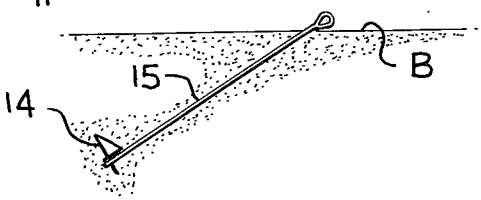
FIG.11

APPARATUS FOR PREVENTING EROSION OF THE SEABED IN FRONT OF HYDRAULIC STRUCTURES

The present invention is directed to novel apparatus for and methods of preventing erosion of the seabed along vertical or steeply inclined hydraulic structures, such as seawalls, piers, jetties, quays, breakwaters, etc.

In any body of water with an erodible bed and having wave action any hydraulic structure with a steep face causes erosion problems because the structure reflects the waves and correspondingly increases their height. The bed sediment which is placed in motion by the undercurrents or underflow due to the wave action is carried away from the antinodes and accumulates in the nodes of the standing wave. Thus, at the steep face of any such hydraulic structure opposing wave motion the seabed is eroded or lowered considerably and the hydraulic structure, be it a pier, seawall, or the like may be endangered.

The convention manner of counteracting such erosion is to establish a mound of rubble in front of the structure which may be, for example, heavy and generally large size rocks. This rubble is dumped into the sea adjacent the hydraulic structure and assumes a natural sloping configuration with the sloping or inclined surface tending to break the wave action and prevent wave reflection. Obviously this mound of rubble may itself be subject to undesirable erosion and to prevent this a sheet of plastic material is often placed on the seabed before the rubble is dumped thereupon. However, this is an expensive way of reducing and/or preventing the erosion of the seabed adjacent a steep faced hydraulic structure.

The present invention is directed to a new and inexpensive method of and apparatus for establishing a slope in front of the hydraulic structure by means of a sloping or inclined sheet of flexible or rigid material by which the hollow beneath the sheet when in place before the hydraulic structure will be filled by sediment and a stable slope is created which breaks the waves and thereby prevents erosion. The hollow space beneath the inclined sheet will fill automatically with sediment caused by wave action, but in order to speed up the process this hollow may be filled artificially by dumping therein sand, gravel, rocks or the like.

With the above and other objects in view that will hereinafter appear, the nature of the invention will be more clearly understood by reference to the following detailed description, the appended claimed subject matter, and the several views illustrated in the accompanying drawings. , In the drawing:

FIG. 1 is a top plan view of a novel sheet constructed in accordance with this invention, and illustrates the manner in which the sheet be it rigid or flexible, imperforated or perforated, is supported adjacent a hydraulic structure.

FIG. 2 is a cross-sectional view taken generally along line 2—2 of FIG. 1, and illustrates the inclination of the sheet and the manner it is supported in this fashion relative to the seabed and the hydraulic structure.

FIG. 3 is a fragmentary top plan view of a segment of a sheet, and illustrates therein the formation of conical channels.

FIG. 4 is a sectional view taken along line 4—4 of FIG. 3, and illustrates the conical configuration.

FIG. 5 is a fragmentary top plan view of another segment of a sheet, and illustrates there being formed therein triangular panels defined by fold lines and cut lines.

FIG. 6 is a cross-sectional view taken generally along 6—6 of FIG. 5, and more clearly illustrates the configuration of the sheet.

FIG. 7 is a top plan view of another segment of a sheet constructed in accordance with this invention, and illustrates an open grid having vertical and/or slanting sidewalls.

FIG. 8 is a fragmentary sectional view taken generally along line 8—8 of FIG. 7, and illustrates details of the open grid sidewalls.

FIG. 9 is a top plan view of another segment of a sheet, and illustrates several layers of mesh superimposed upon each other.

FIG. 10 is a cross-sectional view taken along 10—10 of FIG. 9, and more specifically illustrates the layers of mesh.

FIG. 11 is a vertical cross-section through a seabed, and illustrates a spiral-formed anchor plate for securing the apparatus ofthis invention relative to a seabed.

Reference is made specifically to FIGS. 1 and 2 of the drawing which illustrates a sheet generally designated by the reference numeral 1 which may beconstructed from flexible or rigid material. The sheet 1 may be imperforate or may be provided with perforations or apertures 2 and is supported in a generally inclined fashion (FIG. 2) relative to a hydraulic structure S, such as a seawall, pier, jetty, or the like adjacent a seabed B which might be subject to erosion due to wave action of a body of water W. The sheet 1 may be a single sheet or made up of a plurality of smaller sheets joined to each other of a uniplanar configuration or of a wavy configuration (not shown) as viewed in cross-section. In the latter case the waves of the sheet 1 may extend perpendicular or parallel to the face F of the hydraulic structure S which is to be protected. In the case of a rigid sheet 1, the same may be constructed from sheet aluminnium, sheet iron or glass fiber-reinforced polyester, while in the case of flexible sheets which could be more economical the same may be constructed of polyethylene, polypropylene nylon, polyester or aromatic polyamide.

The apertures 2 of the sheet are formed therein to prevent excessive differences in hydraulic pressure between upper and lower sides of the sheet and/or to cause a reduction in the amplitude of the waves and/or to ease the admission of sediment through the perforations 2 into the hollow (unnumbered) between the sheet 1, the face F of the hydraulic structure S, and the seabed B.

The sheet 1 is supported on its underside by a plurality of transverse bars 3 which are in turn supported by and secured to parallel beams 4. Opposite ends of the beams 4 or the terminal bars 3 are secured to the hydraulic structure S and to the seabed B by suitable means, as, for example, vertical anchoring poles or posts 5. In this fashion the sheet l, the bars 3 and the beams 4 are essentially a united structure which is anchored in the inclined position shown in FIG. 2 to reduce erosion of the seabed B beneath the sheet 1 in the area of the face F.

Under certain conditions the sheet 1 might, of course, be totally devoid of the apertures 2. However, such perforations or apertures 2 might be desirable, as might be a differentiation of the permeability of the sheet 1 by, for example, differing the spacing in between the holes or apertures 2 and/or differentiating the sizes of the holes 2, or by joining together a number of sheets of evenly perforated material on top of or in superimposed relationship to each other. In accordance with the local conditions the permeability may, for instance, be uniform over the entire sheet 1 or it may be increased gradually from the lower to the upper edge of the sheet, as shown in FIG. 1, or it may decrease, or it may decrease gradually from the middle to the edges of the sheet, or it may increase from the middle toward the edges. The perforations may be so fine-meshed that passage of the coarser part of the sediment is prevented, and a sheet typical for such use might be constructed of polyester, nylon or aromatic polyamide mesh.

Various different types of sheets to achieve the collection of sediment therebeneath are shown in FIGS. 5 through 10.

In FIGS. 3 and 4 a sheet 6 includes a plurality of conical channels 7 to further an upward and prevent a downward flow through the sheet.

In FIGS. 5 and 6 a sheet 8 includes a plurality of cut lines 9 and fold lines 10 which form generally triangular channels such that material deposited atop the sheet 8 can pass through the slits 9 to the underside thereof for collection adjacent the hydraulic structure which is to be guarded against erosion.

FIGS. 7 and 8 illustrate a plurality of superimposed sheets 12 secured to and supported by a plurality of parallel vertical rails 11 with leading and trailing edges (unnumbered) of the sheets 12 being in overlapped spaced relationship, in the manner best illustrated in FIG. 8. In this way material can pass between the overlapped edges thereof for subsequent deposit therebeneath.

FIGS. 9 and 10 illustrate a plurality of layers 13 of mesh material, such as polyester or polyamide. In this case they are so arranged to define a plurality of conical channels 16 in order to further an upward flow through the mesh. The layers may be tightly interconnected to act as one sheet. Or they may be joined together in certain lines or points only, so that they can separate where the flow passes through. In the latter case the dimensions of the different layers of mesh differ slightly, so that the amplitudes of their oscillations under the wave action differ correspondingly. In a preferred embodiment the uppermost layer is strained while the other layers underneath are loose, the looseness gradually increasing downwards. Downward flow therefore separates the layers, so that the sediment particles can pass through the layers of mesh. Upward flow will press the layers together and thereby prevent the coarser part of the sediment from passing through the diminished openings of the combined layers of mesh.

FIG. 11 simply illustrates a spiral-formed disc 14 which is screwed into the bottom B by means of a detachable rod 15, and this structure may be employed in lieu of the pegs or posts 5 of FIGS. 1 and 2.

While preferred forms and arrangements of parts have been shown in illustrating the invention, it is to be clearly understood that various changes in detail and arrangement of parts may be made without departing from the spirit and scope of this disclosure.

I claim:

1. The combination of a lengthy hydraulic structure having a steep generally upright uniplanar face, an upper end and a lower end, said lower end being disposed below an upper water level surface of a body of water, a sheet of flexible material, said sheet of flexible material being composed at least of first and second flexible layers, said sheet having upper and lower edge portions, said sheet being disposed at an acute angle to said upright face with said lower edge portion being contiguous a bed of said body of water and said upper edge portion being contiguous said upright face at a point spaced above said bed and below said upper end, said first and second layers including a plurality of perforations, said second layer overlying said first layer, said second layer being taut and said first layer being relatively loose, means for maintaining said sheet of material disposed at said acute angle, and said maintaining means including means for securing said upper and lower edge portions to said hydraulic structure and said bed, respectively.

2. The combination as defined in claim 1 including a plurality of beams underlyingly supporting said sheet and extending generally between said structure and said bed.

3. The combination as defined in claim 1 wherein said sheet includes additional layers each having a plurality of perforations, said additional layers being disposed beneath said first layer, said additional layers also being loose, and the looseness of said first and additional layers increases in a direction away from said second layer.

4. The combination as defined in claim 3 including a plurality of beams underlyingly supporting said sheet and extending generally between said structure and said bed.

5. The combination as defined in claim 1 wherein the perforations of said first and second layers are created by constructing said layers from mesh material.

* * * * *